US010232239B1

(12) United States Patent
Boring

(10) Patent No.: US 10,232,239 B1
(45) Date of Patent: Mar. 19, 2019

(54) DISC GOLF GAME SYSTEM

(71) Applicant: Gary A. Boring, Cody, WY (US)

(72) Inventor: Gary A. Boring, Cody, WY (US)

( * ) Notice: Subject to any disclaimer, the term of this patent is extended or adjusted under 35 U.S.C. 154(b) by 0 days.

(21) Appl. No.: 15/831,946

(22) Filed: Dec. 5, 2017

(51) Int. Cl.
*A63B 67/06* (2006.01)
*A63B 63/00* (2006.01)
*A63B 71/06* (2006.01)
*A63B 71/02* (2006.01)

(52) U.S. Cl.
CPC ..... *A63B 63/007* (2013.01); *A63B 67/06* (2013.01); *A63B 71/023* (2013.01); *A63B 71/0622* (2013.01); *A63B 63/00* (2013.01); *A63B 2207/02* (2013.01); *A63B 2210/50* (2013.01)

(58) Field of Classification Search
CPC ..... A63B 67/06; A63B 63/00
USPC ..... 273/398–402; 362/456; 40/579
See application file for complete search history.

(56) References Cited

U.S. PATENT DOCUMENTS 1,837,894 A * 12/1931 Bosche ..... G09F 11/00 40/437
2,168,223 A * 8/1939 Lauve, Jr. ..... G09F 13/06 264/DIG. 66
3,428,319 A * 2/1969 Engle ..... A63B 63/00 248/156
4,229,894 A * 10/1980 Beck ..... G09F 13/06 40/579
4,378,944 A 4/1983 Johnston
4,386,779 A * 6/1983 Whitlock ..... A63B 67/06 273/336
4,898,392 A * 2/1990 Goletz ..... A63B 63/08 273/123 R
5,354,052 A * 10/1994 Nicholls ..... A63B 24/0021 473/192
5,397,130 A * 3/1995 Brown ..... A63B 63/00 116/173
6,889,982 B1 * 5/2005 Gove ..... A63B 63/00 273/343
8,187,113 B2 * 5/2012 Lim ..... A63B 57/357 473/176
8,608,167 B2 12/2013 Raymond
8,753,218 B2 6/2014 Suchanek
9,165,483 B2 * 10/2015 Cobane ..... G09F 13/02
9,416,959 B2 * 8/2016 Spinner ..... F21V 33/008
9,827,474 B2 * 11/2017 Sciandra ..... A63B 67/06
9,928,764 B2 * 3/2018 Heath ..... G09F 17/00
9,943,737 B1 * 4/2018 Burdan ..... A63B 67/06
(Continued)

FOREIGN PATENT DOCUMENTS

WO WO2011011770 A1 1/2011

*Primary Examiner* — Mark S Graham
(74) *Attorney, Agent, or Firm* — Neustel Law Offices

(57) ABSTRACT

A disc golf game system which utilizes lighted targets to play a new and unique disc golf game during daytime or nighttime. The disc golf game system generally includes a plurality of targets arranged to form a disc golf course. Each of the targets includes a pole which is positioned upright on a ground surface, such as by a base. Each target includes one or more holes formed along its length; with the number of holes present on each target identifying the order in which the targets are to be played on the disc golf course. Each target may include a light source adapted to illuminate the one or more holes so that the targets can be easily identified in low-light conditions. Also disclosed is a method of playing a disc golf game utilizing the targets.

7 Claims, 14 Drawing Sheets

(56) References Cited

U.S. PATENT DOCUMENTS

| | | | | |
|---|---|---|---|---|
| 2002/0122306 | A1* | 9/2002 | O'Connell | G09F 13/04 362/145 |
| 2004/0083633 | A1* | 5/2004 | Mueller | G09F 17/00 40/541 |
| 2004/0204258 | A1* | 10/2004 | Hanoun | A63B 24/0021 473/154 |
| 2007/0212973 | A1 | 9/2007 | Brockes | |
| 2008/0153614 | A1* | 6/2008 | Marshall | A63B 63/00 473/158 |
| 2008/0224409 | A1 | 9/2008 | Marshall | |
| 2009/0291782 | A1 | 11/2009 | Hinn | |
| 2010/0160057 | A1* | 6/2010 | Willett | A63B 57/357 473/176 |
| 2011/0095484 | A1 | 4/2011 | Scott | |
| 2011/0195805 | A1 | 8/2011 | Sliger | |
| 2012/0312286 | A1 | 12/2012 | Kilian | |
| 2014/0185278 | A1* | 7/2014 | Burkart | F21V 33/008 362/183 |
| 2017/0021254 | A1 | 1/2017 | Wolf | |

* cited by examiner

DISC GOLF GAME SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a disc golf game system which utilizes lighted targets to play a new and unique disc golf game during daytime or nighttime.

Related Art

Any discussion of the related art throughout the specification should in no way be considered as an admission that such related art is widely known or forms part of common general knowledge in the field.

Disc golf has been popular for decades and has exhibited considerable growth in past years. Disc golf typically involves players throwing flying discs through a course of "disc golf holes". Disc golf is typically played with rules similar to conventional golf: each player takes turns throwing a disc toward each hole, with the players keeping score of how many throws each takes to complete the course. The player with the lowest score (and thus the least amount of throws) at the end of the course is the winner.

Typical disc golf "holes" are not holes at all—instead they are baskets formed by a pole having a plurality of chains arranged to form a receptacle into which the discs are thrown. Such baskets are in common use on disc golf courses throughout the world. While some players have taken to attaching lights (such as flashlights or LED's) to the baskets to allow play in low-light conditions, there can still be confusion about the order in which the baskets are played. An illuminated basket in the distance does not provide any indication of which "hole" it is on the disc golf course unless one were to approach more closely to read the typical marker at the start of each "hole".

SUMMARY

An example embodiment is directed to a disc golf game system. The disc golf game system includes a plurality of targets arranged to form a disc golf course. Each of the targets includes a pole which is positioned upright on a ground surface, such as by a base. Each target includes one or more holes formed along its length; with the number of holes present on each target identifying the order in which the targets are to be played on the disc golf course. Each target may include a light source adapted to illuminate the one or more holes so that the targets can be easily identified in low-light conditions. Also disclosed is a method of playing a disc golf game utilizing the targets.

There has thus been outlined, rather broadly, some of the embodiments of the disc golf game system in order that the detailed description thereof may be better understood, and in order that the present contribution to the art may be better appreciated. There are additional embodiments of the disc golf game system that will be described hereinafter and that will form the subject matter of the claims appended hereto. In this respect, before explaining at least one embodiment of the disc golf game system in detail, it is to be understood that the disc golf game system is not limited in its application to the details of construction or to the arrangements of the components set forth in the following description or illustrated in the drawings. The disc golf game system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview.

Figure 1:
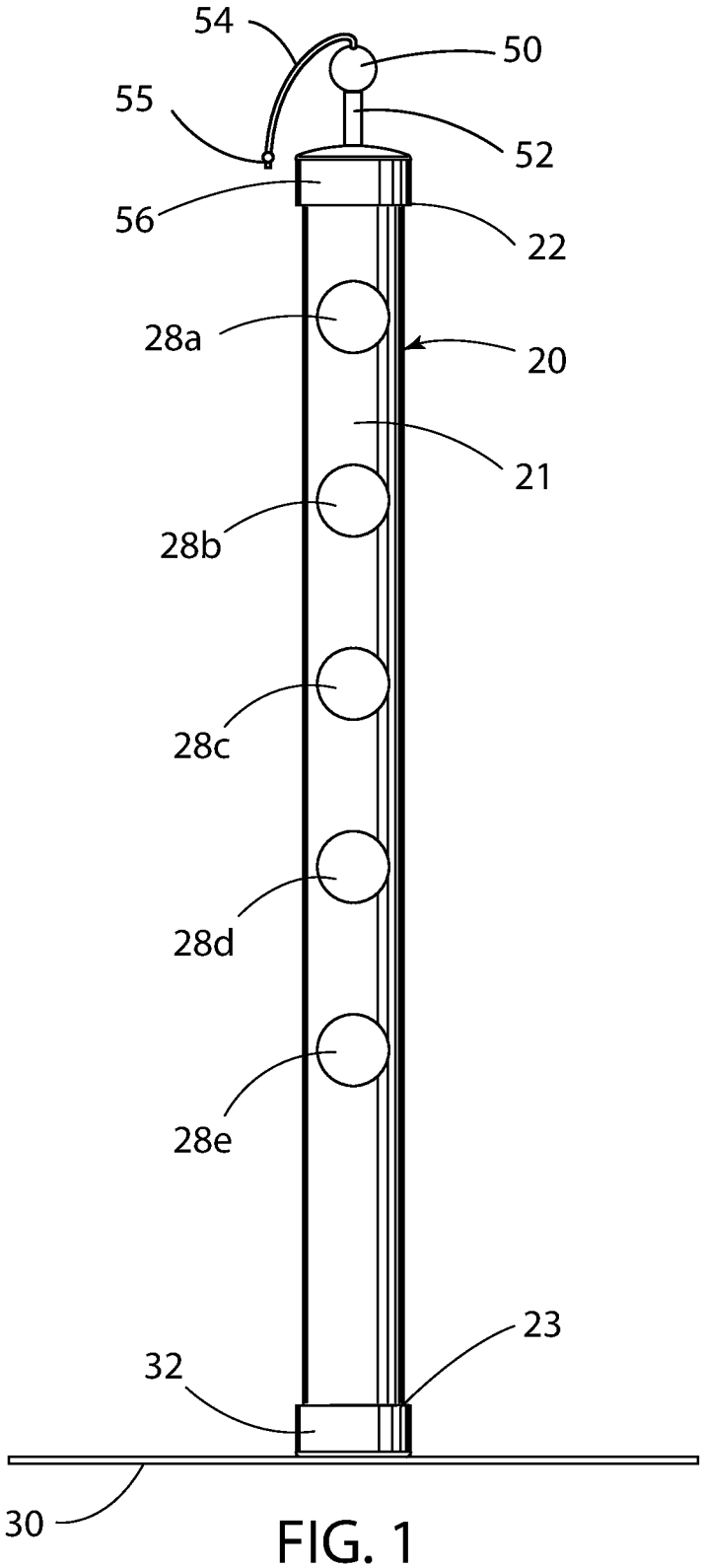
FIG. 1 is a frontal view of a target of a disc golf game system in accordance with an example embodiment.
Figure 2:
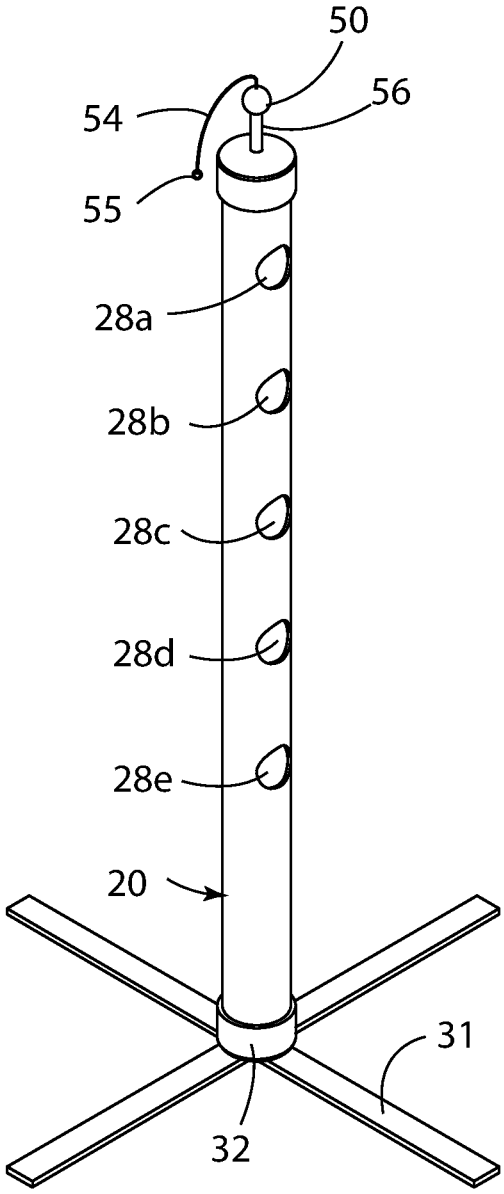
FIG. 2 is a perspective view of a target of a disc golf game system in accordance with an example embodiment.
Figure 3:
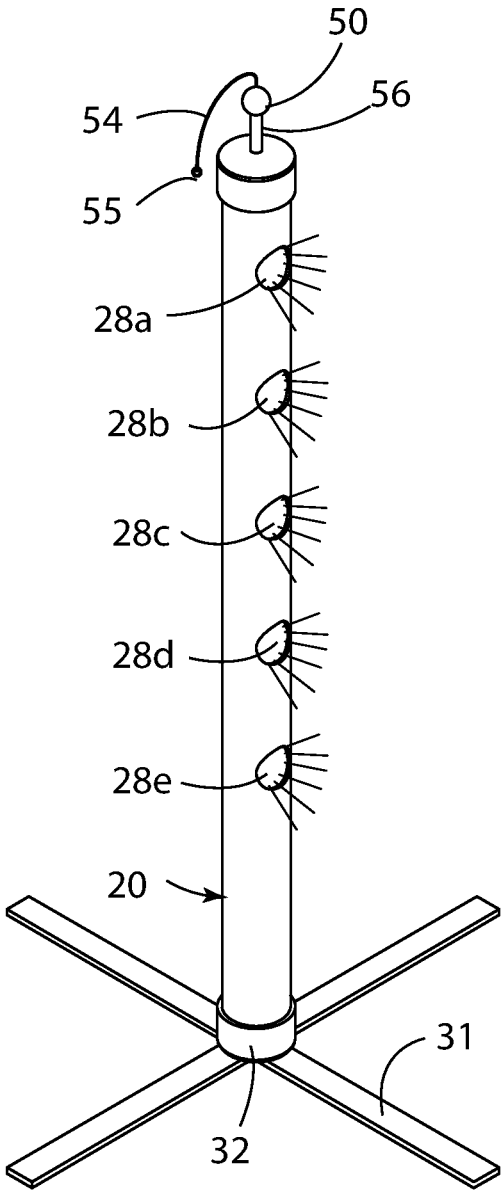
FIG. 3 is a frontal view of an illuminated target of a disc golf game system in accordance with an example embodiment.
Figure 4:
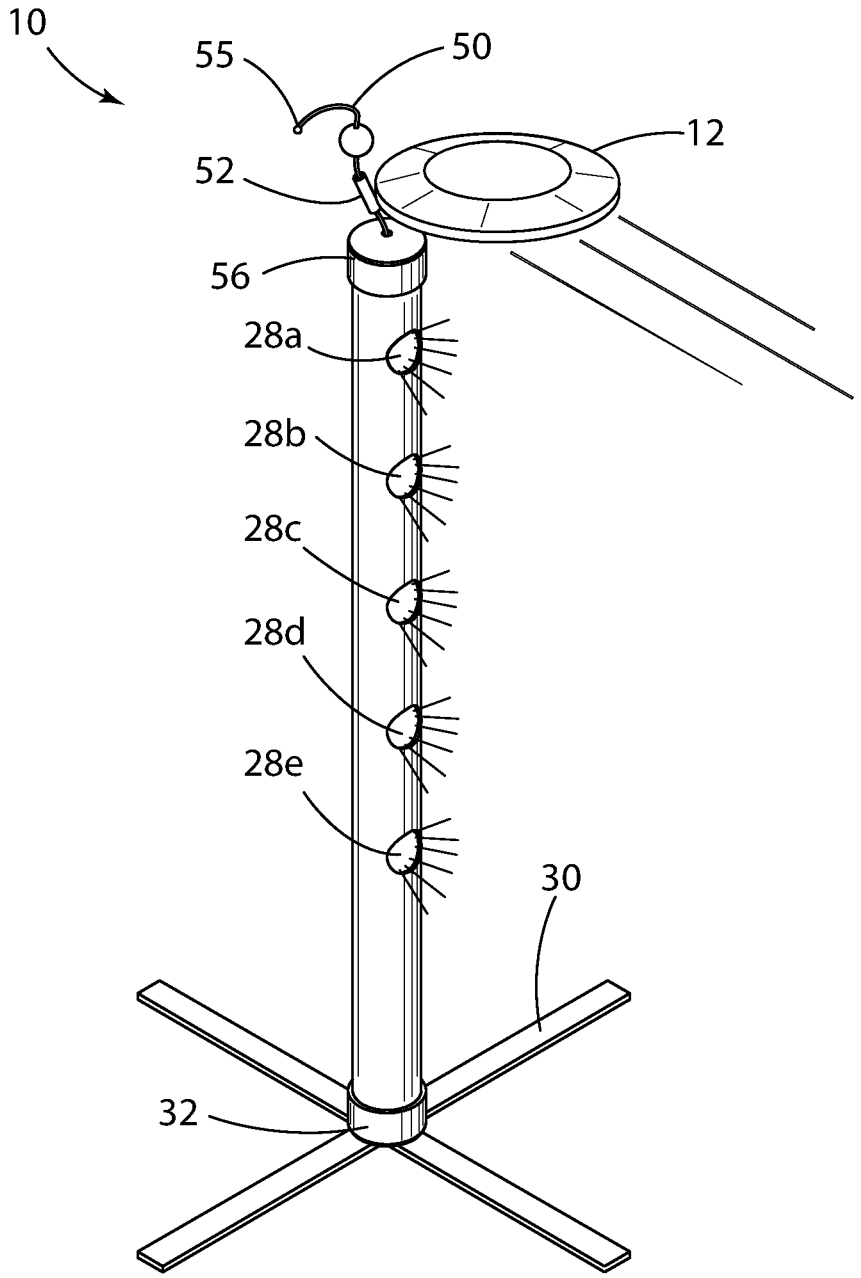
FIG. 4 is a frontal view of a target being hit by a flying disc of a disc golf game system in accordance with an example embodiment.

An example disc golf game system 10 generally comprises a target 20 adapted to be positioned upright on a ground surface. As shown in FIGS. 1-3, the target 20 may comprise an upper end 22, a lower end 23, and a channel 24 extending between the upper end 22 and the lower end 23. The target 20 may include one or more holes 28 between the upper end 22 and the lower end 23 of the target 20, wherein the target 20 is adapted to be identified by a number of the holes 28 on the target 20.

The target 20 may include a light source 40 such as a light-emitting diode or the like which is connected to the target 20 so as to emit light through the one or more holes 28 of the target 20. The light source 40 may be removably connected to the target 20. The target 20 may include a holder 44 adapted to be removably connected within the channel 24 of the target 20; with the light source 40 being removably connected to the holder 44. The light source 40 may be adapted to emit light through the channel 24 of the target 20.

The target 20 may also include an indicator 50 connected to the target 20. The indicator 50 may be adapted to be positioned on the upper end 22 of the target 20. The indicator 50 may be adapted to be knocked off of the target 20 when the target 20 is hit with a flying object 12 such as a disc. The indicator 50 may be adapted to be suspended above a ground surface when the indicator 50 is knocked off the target 20, such as by a linkage 54 connected between the indicator 50 and the target 20.

The linkage 54 may be connected through the tee 52 and the indicator 50; with a stopper 55 to prevent the tee 52 and the indicator 50 from being disconnected from the target 20. The indicator 50 may comprise a ball as shown in the exemplary figures. A tee 52 may be positioned on the upper end 22 of the target 20; with the indicator 50 being adapted to be positioned on the tee 52 so as to fall off the tee 52 if the target 20 is struck by a flying object 12.

Figure 8:
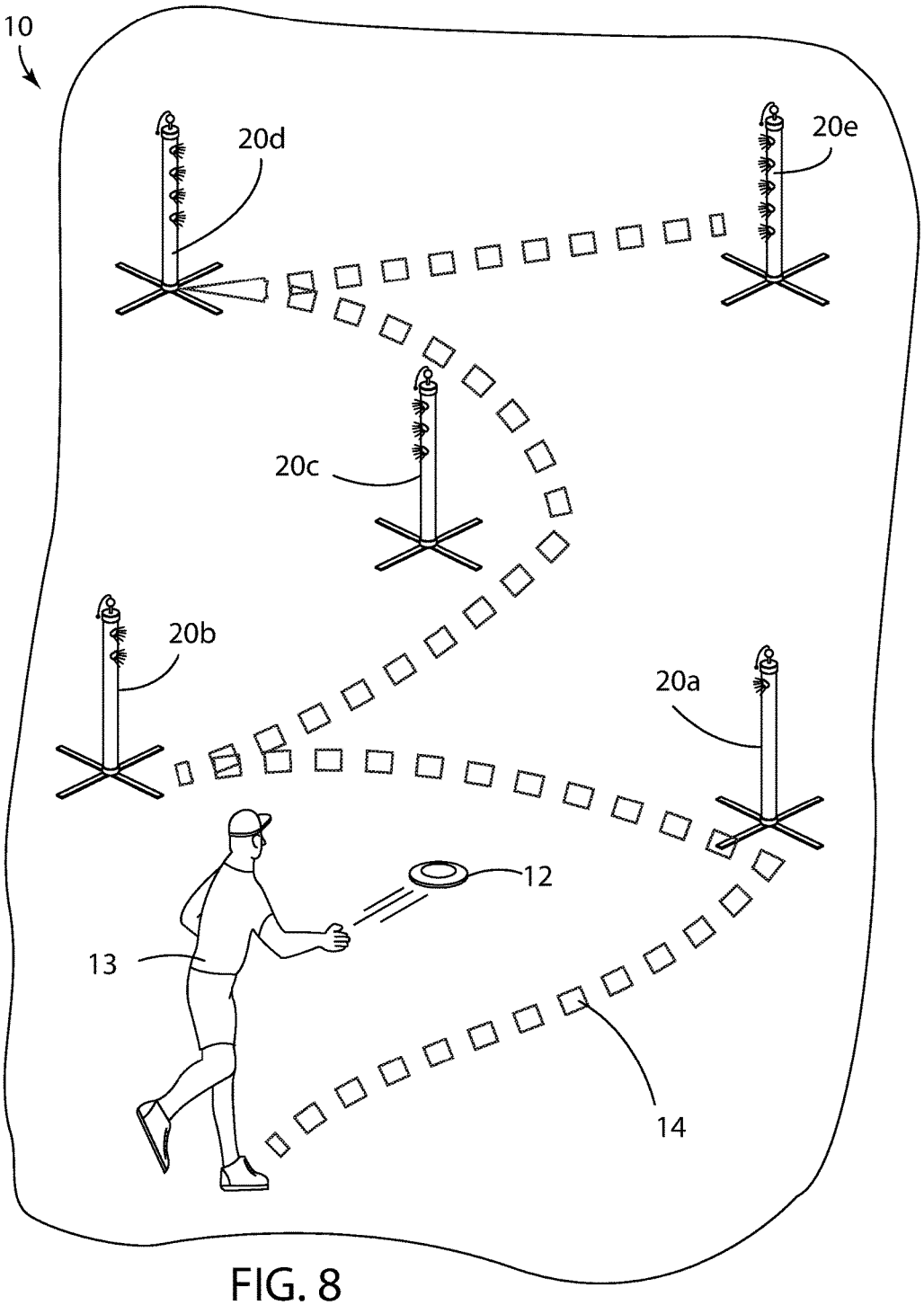
FIG. 8 is a perspective view of a plurality of targets arranged to form a course of a disc golf game system in accordance with an example embodiment.

As shown in FIG. 8, a plurality of targets 20*a*, 20*b*, 20*c*, 20*d*, 20*e* may be arranged to form a course 14 for playing a disc golf game. Each of the targets 20*a*, 20*b*, 20*c*, 20*d*, 20*e* may comprise a pole 21 adapted to be positioned upright on the ground surface; the pole 21 comprising an upper end 22, a lower end 23, and a channel 24 extending between the upper end 22 and the lower end 23.

The pole 21 of each target 20 may comprise one or more holes 28*a*, 28*b*, 28*c*, 28*d*, 28*e* between the upper end 22 and the lower end 23 of the pole 21; with the pole adapted to be identified by a number of the holes 28*a*, 28*b*, 28*c*, 28*d*, 28*e* on the pole 21. For example, the plurality of targets 20 could comprise a first target 20*a*, a second target 20*b*, and a third target 20*c*. The first target 20*a* may be identified by one hole 28*a*, the second target 20*b* may be identified by two holes 28*a*, 28*b*, and the third target 20*c* may be identified by three holes 28*a*, 28*b*, 28*c*.

Each of the targets 20*a*, 20*b*, 20*c*, 20*d*, 20*e* may comprise a light source 40 connected to the pole 21 so as to emit light through the one or more holes 28*a*, 28*b*, 28*c*, 28*d*, 28*e* of the pole 21. An indicator 50 may be connected to each pole 21; the indicator 50 being adapted to be positioned on the upper end 22 of the pole 21 and to be knocked off of the pole 21 when the pole 21 is hit with a flying object 12. Each of the targets 20*a*, 20*b*, 20*c*, 20*d*, 20*e* may include a linkage 54 connected between the pole 21 and the indicator 50. Each of the targets 20*a*, 20*b*, 20*c*, 20*d*, 20*e* may also comprise a tee 52 adapted to be removably positioned on the upper end 22 of the pole 21 such that the indicator 50 may be positioned on the tee 52 so as to be knocked off of the tee 52 if the pole 21 is struck by a flying object 12. The indicator 50 of each of the targets 20*a*, 20*b*, 20*c*, 20*d*, 20*e* may comprise a ball.

As shown in FIGS. 10-14, a method of playing a disc golf game is also disclosed. A plurality of targets 20*a*, 20*b*, 20*c*, 20*d*, 20*e* may be arranged to form a course 14 for playing the disc golf game. The targets 20*a*, 20*b*, 20*c*, 20*d*, 20*e* may comprise a first target 20*a* having a first light source 40 adapted to illuminate one hole 28*a* on the first target 20*a* and a second target 20*b* having a second light source 40 adapted to illuminate two holes 28*a*, 28*b* on the second target 20*b*.

A pair of players 13 may each throw a flying object 12 such as a disc toward the first target 20*a*; with the first or second player 13 scoring a first point value when the first or second player 13 hits the first target 20*a* with the first or second flying object 12. The players 13 may then repeat the same steps with the second target 20*b*, with the first or second player 13 scoring a second value when the first or second player 13 hits the second target 20*b* with the first or second flying object 12. The first or second player 13 may win the disc golf game by accumulating a preset point value. If at any time a second flying object 12 lands in a position in which it is in contact with a first flying object 12, the first flying object 12 will be disqualified from the target 20*a*, 20*b*, 20*c*, 20*d*, 20*e* being played.

B. Targets.

As best shown in FIGS. 1-6, the disc golf game system 10 may comprise a target 20 adapted to support an indicator 50. In the exemplary embodiment shown in FIGS. 1-6, the target 20 may comprise a pole 21 having an upper end 22, a lower end 23, and a channel 24 extending between the upper end 22 and the lower end 23.

Figure 9:
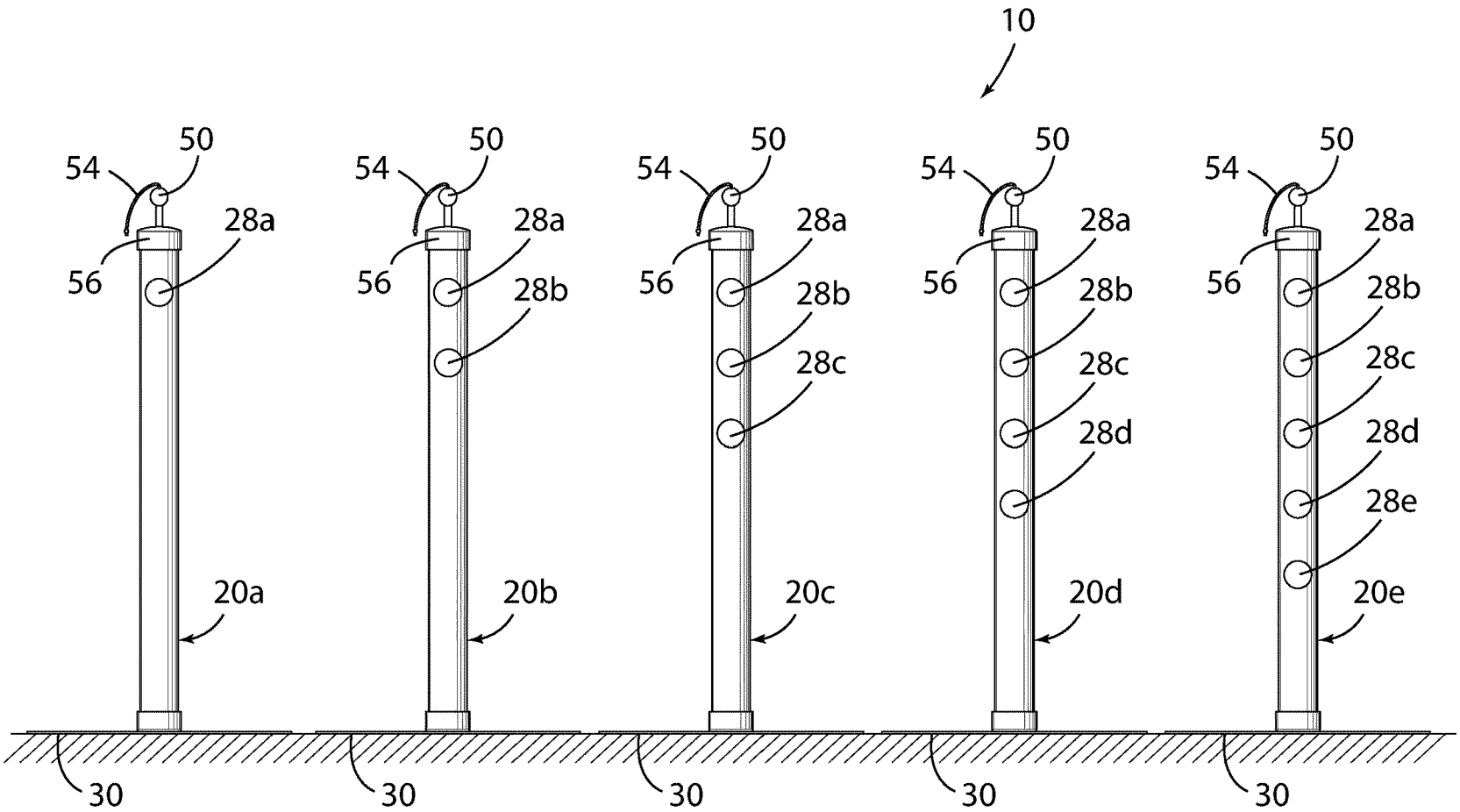
FIG. 9 is a frontal view of a plurality of targets of a disc golf game system in accordance with an example embodiment.

The pole 21 may be adapted to be positioned upright on a ground surface such as shown in FIG. 9. Although the figures illustrate the pole 21 being stood upright by use of a base 30, it should be appreciated that in some embodiments the pole 21 may be stood upright by any number of methods; such as by inserting the pole 21 in a hole formed in the ground surface. Although the figures illustrate the pole 21 as being positioned in a vertical orientation, it should be appreciated that the pole 21 could be diagonally oriented in some embodiments.

As shown in FIGS. 1-3, the target 20 may include a base 30 which supports the target 20 in an upright position on a ground surface. The base 30 may comprise various configurations and should not be construed as limited by the exemplary figures. In the exemplary embodiment shown in the figures, the base 30 comprises a plurality of legs 31 extending outwardly from the lower end 23 of the target 20.

The legs 31 are illustrated as being oriented to extend radially outward from the target 20 in different directions to form the base 30 of the target 20. Although the figures illustrate the usage of four legs 31 forming a cross-configuration, it should be appreciated that more or less legs 31 could be utilized in different configurations for different embodiments.

Figure 5:
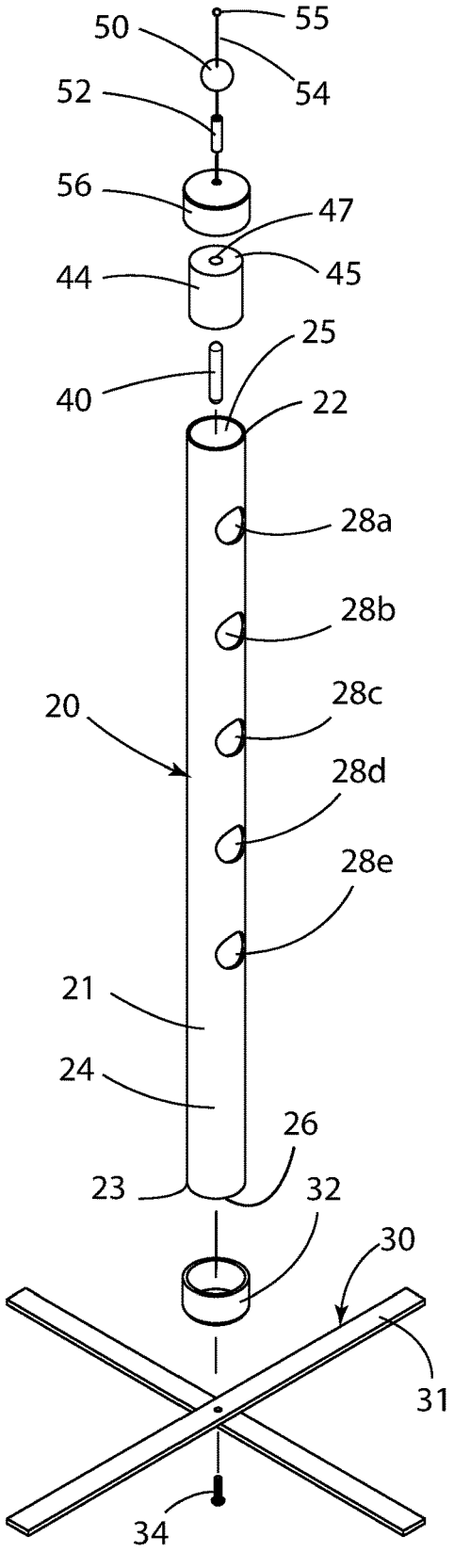
FIG. 5 is an exploded view of a target of a disc golf game system in accordance with an example embodiment.
Figure 6:
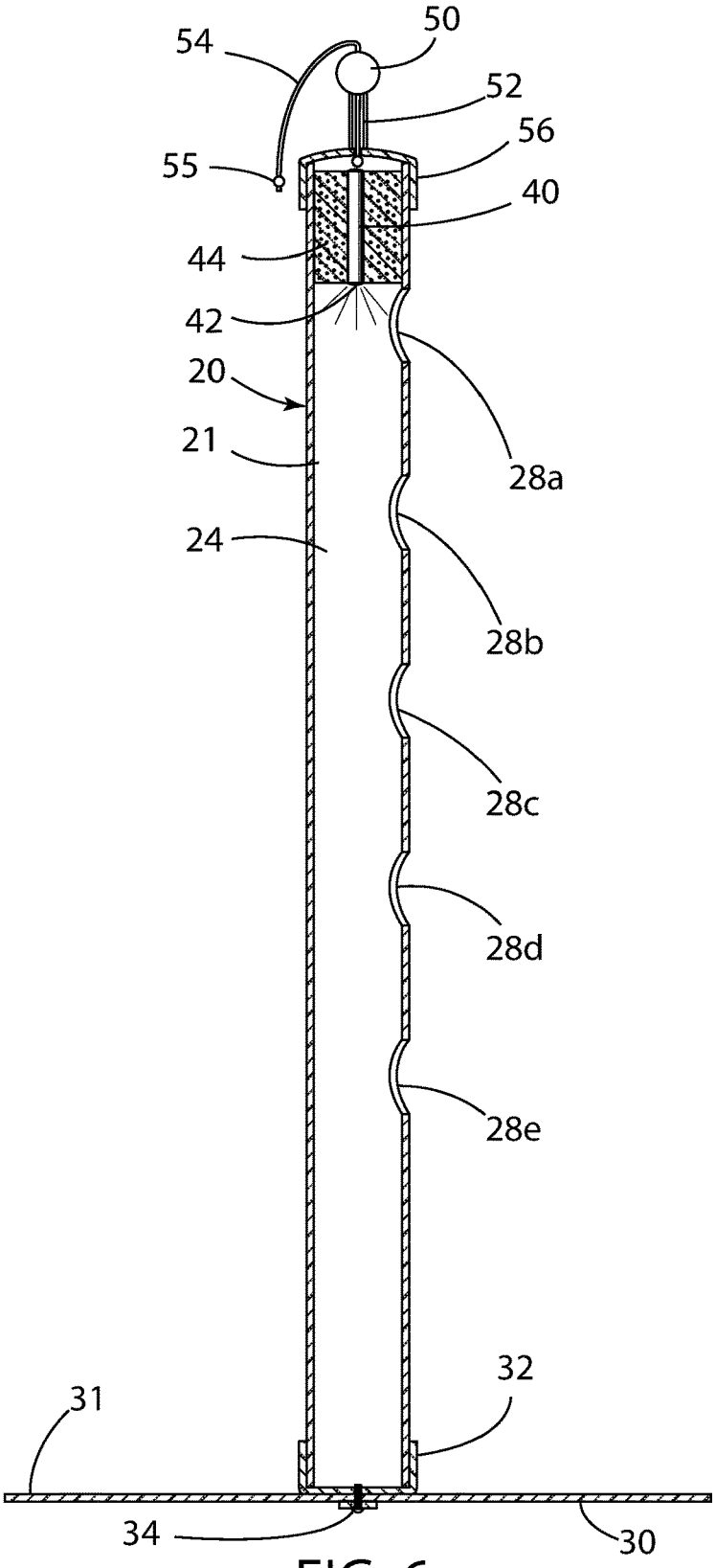
FIG. 6 is a sectional view of a target of a disc golf game system in accordance with an example embodiment.

As shown in FIG. 5, the target 20 may comprise a base connector 32 removably connected to the lower end 23 of the pole 21. The base connector 32 may be connected so as to cover the lower opening 26 of the pole 21. The base connector 32 may comprise a cap or the like as shown in FIG. 5. The base connector 32 may in some embodiments be removably connected to the pole 21. In other embodiments, the base connector 32 may be fixedly connected or integrally formed with the pole 21. The manner in which the base connector 32 is connected to the pole 21 may vary. In the exemplary embodiment shown in the figures, the base connector 32 fits over the lower end 23 of the pole 21 and is retained thereon via frictional engagement.

The legs 31 may be integral with, removably connected to, or fixedly connected to the pole 21 or the base connector 32. In the exemplary embodiment shown in FIG. 5, the legs 31 are connected to the base connector 32. A base fastener 34 may be utilized to secure the base 30 to the lower end 23 of the pole 21 of the target 20. The type of base fastener 34 utilized may vary in different embodiments.

As best shown in FIG. 5, the pole 21 may comprise an upper opening 25 at the upper end 22 of the pole 21 and a lower opening 26 at the lower end 23 of the pole 21. In some embodiments, the pole 21 may include an upper opening 25 but not a lower opening 26, or vice versa. In the exemplary embodiment shown in the figures, the pole 21 may include a base connector 32 adapted to be removably connected to cover the lower opening 26 and a cap 56 adapted to be removably connected to cover the upper opening 25.

As shown in FIG. 2, the target 20 may comprise one or more holes 28. The holes 28 may be arranged or oriented in a range of manners and may be at various different locations on the pole 21. In the exemplary embodiment shown in FIG. 2, a column of holes 28*a*, 28*b*, 28*c*, 28*d*, 28*e* extend along the length of the pole 21 between its upper end 22 and its lower end 23. Various other configurations may be utilized.

The shape and size of the holes 28 may vary in different embodiments. Preferably, the shape and size of the holes 28 will be sufficient to allow players 13 to easily view the holes 28 while standing at the previous target 20 (or the start point of the course 14 if playing the first target 20*a*). In the exemplary embodiment shown in the figures, the holes 28 comprise circular openings arranged in a column. The holes 28 could comprise other shapes, such as various symbols, letters, numbers, or the like in different embodiments.

Players 13 may utilize the number of holes 28 on each target 20 to identify the target's 20 location on the course 14. For example, the number of holes 28 of each target 20 may indicate the order in which the targets 20 are played on a course 14. In such an embodiment, if a first target 20*a* has one hole 28*a* and a second target 20*b* has two holes 28*a*, 28*b*; the first target 20*a* is played before the second target 20*b* unless the course 14 is being played in reverse order as discussed below.

Any number of targets 20 may be utilized in different embodiments of the disc golf game system 10. In the exemplary embodiment shown in FIG. 9, a first target 20*a* is shown having one hole 28*a*, a second target 20*b* is shown having two holes 28*a*, 28*b*, a third target 20*c* is shown having three holes 28*a*, 28*b*, 28*c*, a fourth target 20*d* is shown having four holes 28*a*, 28*b*, 28*c*, 28*d*, and a fifth target 20*e* is shown having five holes 28*a*, 28*b*, 28*c*, 28*d*, 28*e*. Each of the targets 20 is identified by the number of holes 20*a*, 28*b*, 28*b*, 28*d*, 28*e* on the pole 21 of each target 20.

In the exemplary embodiment of FIG. 8, the first target 20*a* having one hole 28*a* would be played first, followed by the second target 20*b* having two holes 28*a*, 28*b*, the third target 20*c* having three holes 28*a*, 28*b*, 28*c*, and so on. The holes 28*a*, 28*b* of each subsequent target 20 may face the previous target 20 on the course 14 so as to be easily visible when standing at the previous target 20. In some embodiments, holes 28 may be on both sides of the target 20 so that the holes 28 may be visible from additional angles.

The holes 28*a*, 28*b*, 28*c*, 28*d*, 28*e* may be adapted to be illuminated by a light source 40. The light source 40 may comprise various devices known to emit light; such as light-emitting diodes (LED's), light bulbs (incandescent, fluorescent, etc.), or chemical compositions adapted to emit light. The light source 40 may be removably connected to the target 20 or may be integral therewith. The location and manner in which the light source 40 is connected to the target 20 may vary.

As best shown in FIG. 3, the light source 40 will preferably be adapted to illuminate each the holes 28*a*, 28*b*, 28*c*, 28*d*, 28*e* of the target 20 so as to easily find and identify each target 20 in low-light or dark conditions. In the exemplary embodiment shown in the figures, the light source 40 is removably positioned within the channel 24 of the target 20.

The light source 40 may be positioned near the upper end 22 of the target 20 so as to emit light downwardly, or it may be positioned near the lower end 23 of the target 20 so as to emit light upwardly. In some embodiments, the light source 40 may be positioned at other locations, such as mid-way between the upper and lower ends 22, 23 of the target 20. The light source 40 may be adapted to direct light through the channel 24 of the target 20 such that the light emanates through the holes 28.

The light source 40 will generally include an emitter 42 which is adapted to emit light from the light source 40. The emitter 42 may be adapted to emit light in various directions and should not be construed as limited to emitting light in a particular direction such as downwardly as shown in the exemplary figures. In the figures, an exemplary embodiment is shown in which the light source 40 comprises an elongated member having the emitter 42 at a distal end thereof. Other configurations may be utilized.

The light source 40 could be integral or fixedly connected to the target 20 in some embodiments. For example, the target 20 could include internal light sources 40 such as LED's within the channel 24 that may be selectively activated to illuminate the holes 28. The holes 28 themselves could be ringed with light emitters 42 in some embodiments. For example, a light string could be used as a light source 40, such as by inserting the light string into the channel 24 or by securing the light string around the holes 28.

In an exemplary embodiment shown in FIG. 5, the light source 40 comprises an elongated member having an emitter 42 at a distal end thereof. A holder 44 is provided having an upper end 45 and a lower end 46; with a channel 47 extending from the upper end 45 to the lower end 46. In such an embodiment, the light source 40 may be removably inserted within the channel 47 of the holder 44; with the emitter 42 adapted to emit light from the upper end 45 and/or the lower end 46 of the holder 44.

The holder 44 may comprise various shapes, sizes, materials, and configurations. In the exemplary embodiment shown in FIG. 5, the holder 44 comprises a cylindrically-shaped resilient insert that is the same size as or slightly smaller than the channel 24 of the target 20 in which it is inserted. Such an embodiment allows the holder 44 to be removably retained within the channel 24 by frictional engagement; with the light source 40 being removably connected to the holder 44 so as to emit light from the holder 44.

When playing in low-light conditions, it may be difficult to ascertain whether a target 20 has been struck by a flying object. Many players 13 have the ability to throw a flying object 12 such as a disc an extremely long distance. In such situations, it may be desirable for there to be a long distance between targets 20 on a course 14 to accommodate the abilities of the players 13. This may result in it being difficult or impossible to ascertain if a target 20 was hit if the target 20 is not visible from the throwing point of the player 13. To accommodate for these situations, each target 20 may include an indicator 50 which is utilized to confirm that the target 20 has been struck by a flying object 12 such as a thrown disc.

FIGS. 1-3 and 6 best illustrate an indicator 50 positioned on a target 20. The indicator 50 will preferably be positioned on or connected to the target 20 such that the indicator 50 will fall off of the target 20 when the target 20 is struck by a flying object 12 such as a disc. The type of indicator 50 used, as well as the manner in which it is positioned on or otherwise connected to the target 20, may vary in different embodiments.

In an exemplary embodiment shown in FIG. 5, the indicator 50 is shown as comprising a ball. Various other objects may be utilized for indicators 50. For example, a hinged lever or the like could be utilized; with the lever being adapted to rotate via the hinge when the target 20 is struck by a flying object 12. Thus, the exemplary embodiments shown in the figures should not be construed as limiting with respect to the type of indicator 50 used.

It may be preferable that the indicator 50 remain connected to the target 20 in some manner even when the target 20 is struck by the flying object 12. If the indicator 50 is not so anchored to the target 20, there may be a risk that the indicator 50 could be lost if it flies off the target 20 and rolls; particularly in forested areas or the like. In the embodiment shown in FIG. 5, a linkage 54 is utilized to anchor the indicator 50 to the target 20 even when the indicator 50 is knocked off of the target 20.

Figure 7:
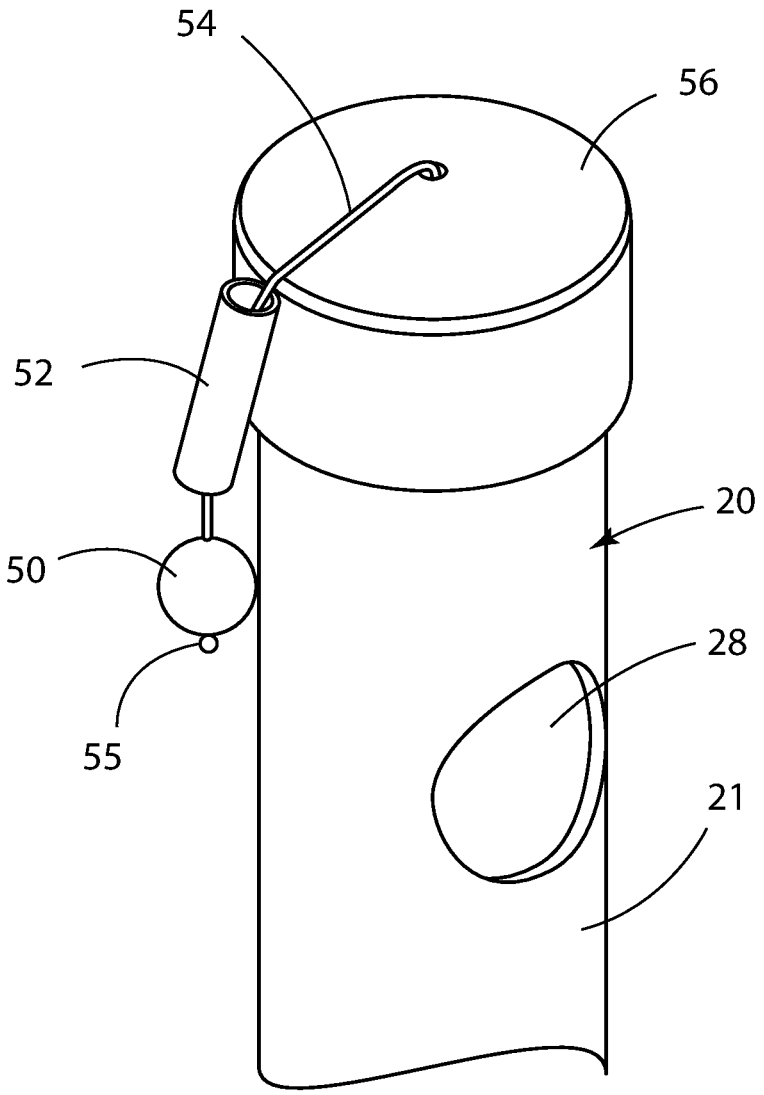
FIG. 7 is a perspective view of an upper end of a target of a disc golf game system in accordance with an example embodiment.

As shown in FIG. 5, the linkage 54 may comprise a cord, cable, string, or the like which is connected between the target 20 and the indicator 50. When the indicator 50 is knocked off of the target 20 by a flying object 12, the indicator 50 will be suspended from the target 20 by the linkage 54 such as shown in FIG. 7. In this manner, it can be assured that the indicator 50 will not be lost.

The target 20 may include a cap 56 removably connected or fixedly connected to the upper end 22 of the target 20. In some embodiments, a cap 56 may be omitted. Use of a removable cap 56 allows access to the internal channel 24 of the target 20 to access, insert, or remove a light source 40. The shape, size, and configuration of the cap 56 may vary in different embodiments. In some embodiments, the indicator 50 may be anchored to the cap 56 as discussed herein.

In some embodiments, the indicator 50 may rest upon a tee 52 which is itself positioned on the upper end 22 of the target 20. In other embodiments, the upper end 22 or the cap 56 of the target 20 may include a divot or other indentation adapted to support the indicator 50 on top of the target 20.

In the exemplary embodiment of FIG. 5, a linkage 54 is shown connected to a cap 56 of a target 20. The linkage 54 extends through both the tee 52 and the indicator 50; with a stopper 55 at the distal end of the linkage 54 to keep the tee 52 and indicator 50 from slipping off the distal end of the linkage 54. Thus, when the indicator 50 and tee 52 are knocked off of the target 20 by a flying object 12, the indicator 50 and tee 52 will be retained on the linkage 54 by the stopper 55 while suspended from the target 20 such as shown in FIG. 7. In some embodiments, the stopper 55 may comprise a bead or knot at the distal end of the linkage 50.

C. Operation of Preferred Embodiment.

There are numerous types of games that could be played with the disc golf system 10 described herein. What follows is a description of exemplary rules for a disc golf game which is able to be played using the disc golf system 10 described herein. It should be appreciated that the methods of play described herein should not be construed as being only applicable to the exemplary embodiments of a disc golf system 10 described previously. The methods of play described herein could be utilized with a wide range of disc golf systems, including the traditional basket configuration currently in wide use.

Figure 10:
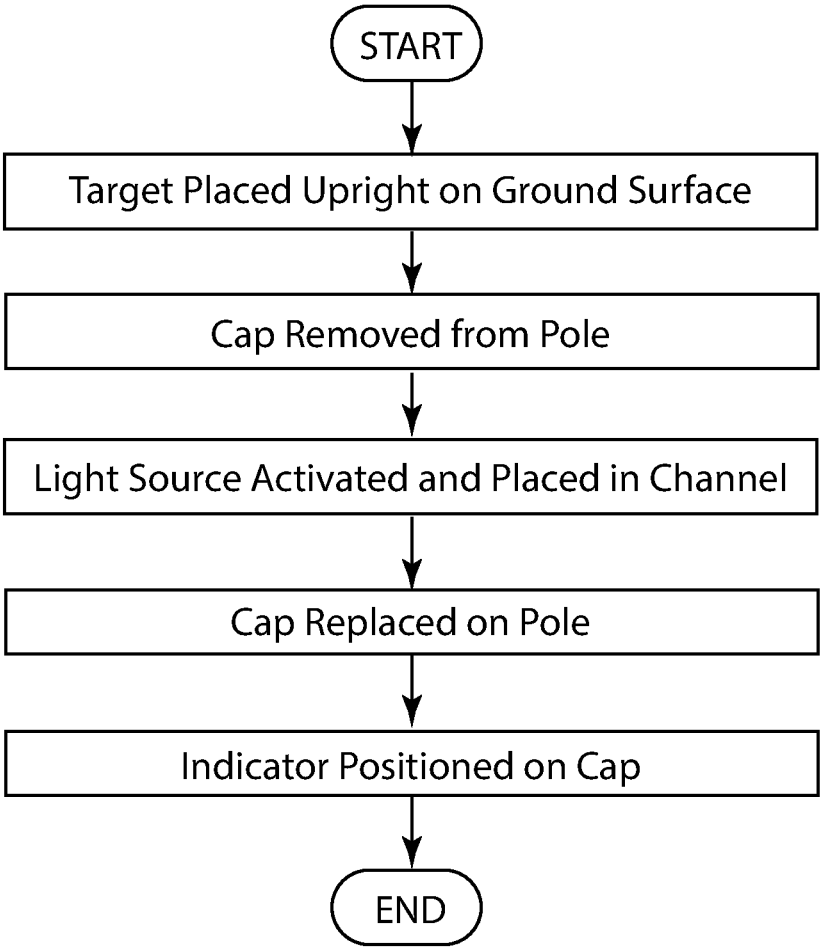
FIG. 10 is a flowchart illustrating setting up a target of a disc golf game system in accordance with an example embodiment.

FIG. 10 is a flowchart illustrating an exemplary method for setting up a target 20 for use in playing a disc golf game. The target 20 is first placed upright on a ground surface. The target 20 could be driven into the ground or supported by a base 30 or other structure. In embodiments which include a cap 56, the cap 56 may be removed to either insert the light source 40 into the channel 24 of the target 20 or access a light source 40 that is already in the channel 24. The light source 40 may activated and the cap 56 replaced on the target 20. In some embodiments, such as when playing in daytime, the light source 40 may be omitted or kept deactivated.

The indicator 50 may then be placed on the cap 56 and the target 20 is ready to play. If the light source 40 is being used, the light source 40 will emit light from its emitter 42 to emanate from the holes 28 of that target 20. In this manner, the holes 28 are illuminated so that a player 13 may easily identify the particular target 20 being viewed by the number of holes 28 on the target 20.

Figure 11:
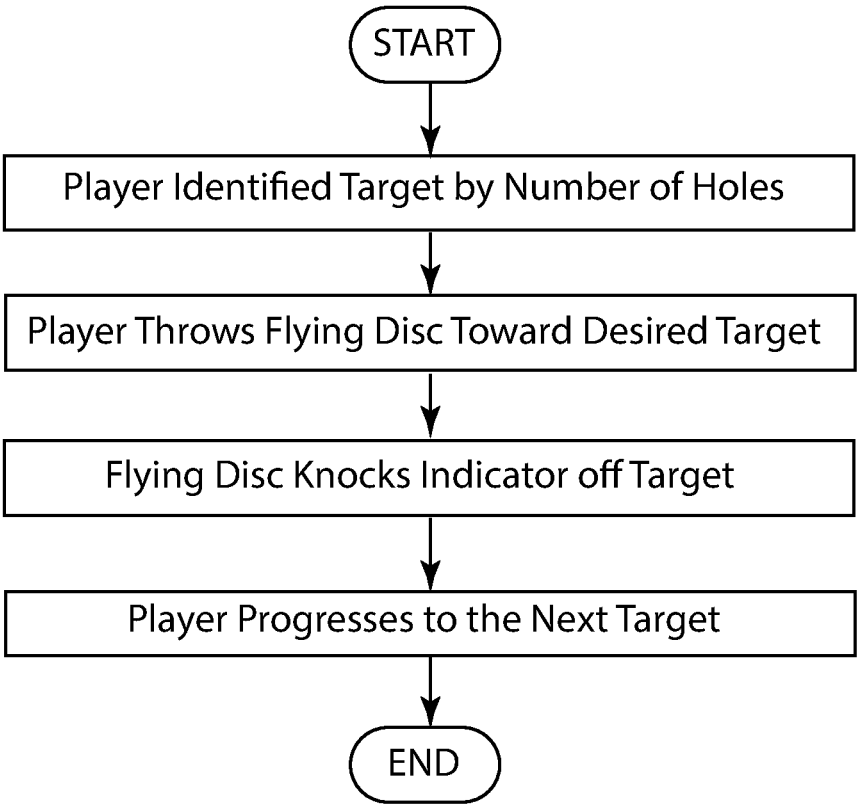
FIG. 11 is a flowchart illustrating identifying and playing a target of a disc golf game system in accordance with an example embodiment.

FIG. 11 is a flowchart illustrating an exemplary method for playing a target 20. The player 13 first identifies the target 20 by the number of holes 28. The holes 28 may be illuminated by the light source 40 in low-light conditions to ease identification. After confirming that they are facing the proper target 20, the player 13 will throw the flying object 12 toward the target 20. If the flying object 12 strikes the target 20, the indicator 50 will be knocked off of the target 20.

If the flying object 12 does not strike the target 20, the player 13 may throw the flying object 12 again toward the target 20 from its landing place of the first throw. This may be repeated until the target 20 is struck, at which time the player 13 may progress to the next target 20 and repeat.

Figure 12:
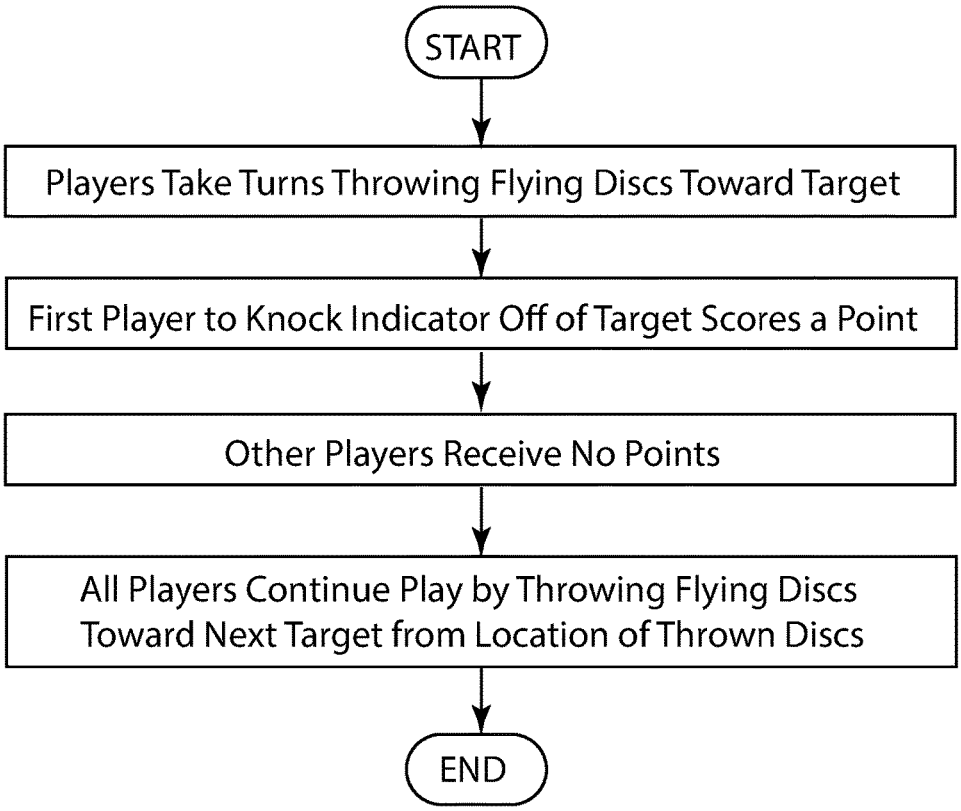
FIG. 12 is a flowchart illustrating a method of playing a disc golf game system in accordance with an example embodiment.
Figure 13:
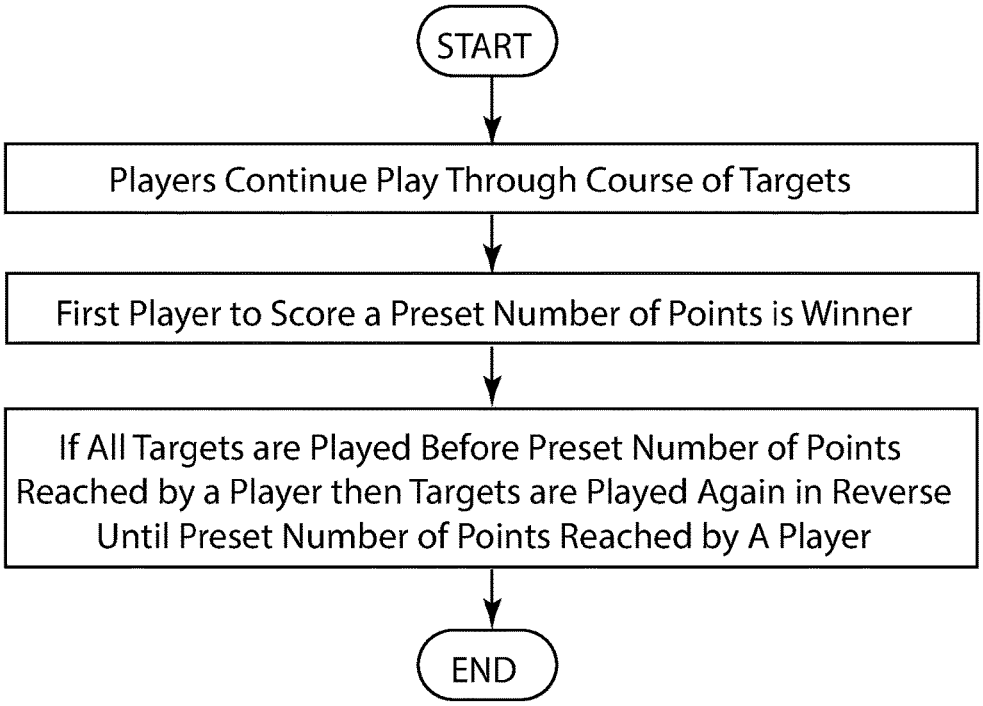
FIG. 13 is a flowchart illustrating a method of playing a disc golf game system in accordance with an example embodiment.

FIGS. 12 and 13 illustrate an exemplary game to be played using the targets 20. Each player 13 will take turns throwing flying objects 12 toward the each target 20 of the course 14 in order. The first player 13 to knock the indicator 50 off of a particular target 20 scores a point. The other players 13 receive no points, and all players 13 progress toward the next target 20.

The players 13 will continue play through all targets 20 of the course 14. The order of the targets 20 is easily identified from the number of holes 28 on each target 20. Play will continue until a player 13 reaches a preset number of points. For example, if the preset number of points is five points, the first player 13 to be the first to strike five targets 20 will be the winner. If all targets 20 are played before the present number of points are reached by a particular player 13, the targets 20 may be played again in reverse. This may be repeated until a player 13 reaches the preset number of points.

Figure 14:
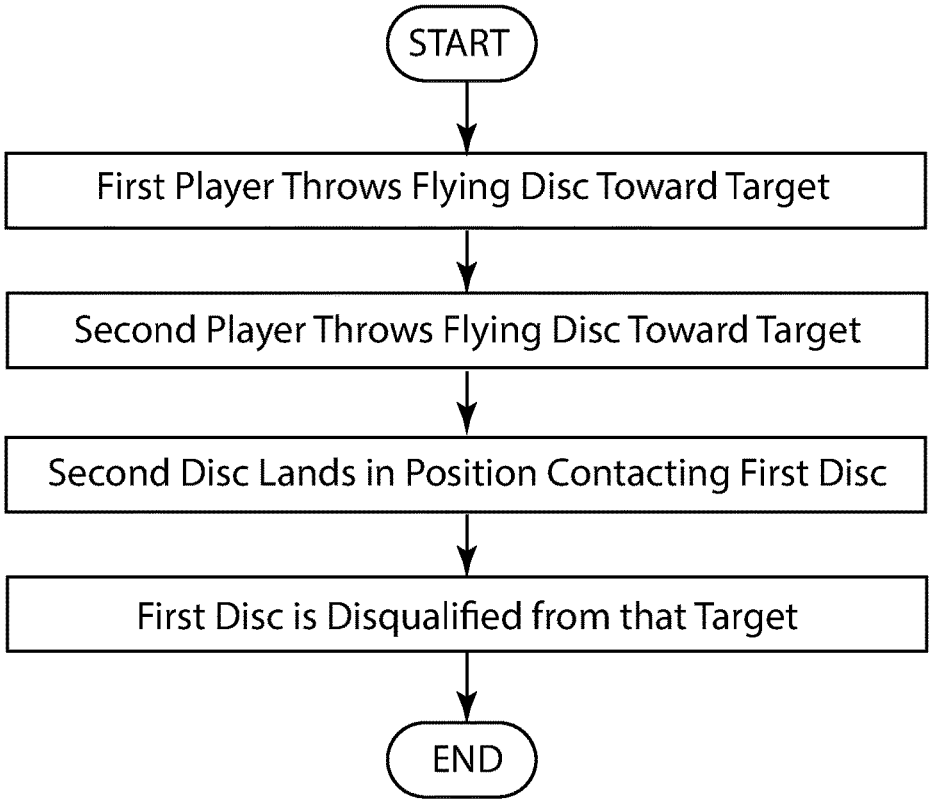
FIG. 14 is a flowchart illustrating a method of playing a disc golf game system in accordance with an example embodiment.

In some embodiments, a "poison rule" may be applied to the method of playing a disc golf game. In such embodiments, such as illustrated in FIG. 14, anytime a first flying object 12 thrown by a first player 13 is in contact with a second flying object 12 thrown by a second player 13 after the second flying object 12 has landed and stopped movement, then the first flying object 12 is disqualified from that target 20. In other words, the first player 13 will stop play on that particular target as their flying object 12 has been "poisoned" by the second player 13. The first player 13 may resume play on the next and subsequent targets 20, subject to the same rule on subsequent throws.

Players 13 could also team up; with each player 13 on a team alternating throws. The preset point value for a player 13 or team to win may be adjusted based upon the skill of the players, the length of the course, and/or the time available for players 13 to play. An exemplary preset point value for two players 13 would be seven points, for three or four players 13 would be five points, for five or six players would be four points, and for six players would be three points. These are merely exemplary, as players 13 will likely want to set up the point values based on their own needs and abilities.

Unless otherwise defined, all technical and scientific terms used herein have the same meaning as commonly understood by one of ordinary skill in the art to which this invention belongs. Although methods and materials similar to or equivalent to those described herein can be used in the practice or testing of the disc golf game system, suitable methods and materials are described above. All publications, patent applications, patents, and other references mentioned herein are incorporated by reference in their entirety to the extent allowed by applicable law and regulations. The disc golf game system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A disc golf game system, comprising:

a plurality of targets adapted to be arranged to form a course for playing a disc golf game, each of the targets comprising:

a pole adapted to be positioned upright on a ground surface, wherein the pole comprises an upper end, a lower end, and a channel extending between the upper end and the lower end;

one or more identification holes between the upper end and the lower end of the pole, wherein the pole is adapted to be identified by a number of the identification holes on the pole;

a light source connected to the pole so as to emit light through the one or more identification holes of the pole; and an indicator connected to the pole, wherein the indicator is adapted to be positioned on the upper end of the pole, wherein the indicator is adapted to be knocked off of the pole when the pole is hit with a flying object;

wherein each of the plurality of targets comprises a different number of identification holes.

2. The disc golf game system of claim 1, wherein the plurality of targets comprises a first target, a second target, and a third target.

3. The disc golf game system of claim 2, wherein the first target consists of one identification hole, wherein the second target consists of two identification holes, and wherein the third target consists of three identification holes.

4. The disc golf game system of claim 3, wherein each of the plurality of targets comprises a linkage connected between the pole and the indicator.

5. The disc golf game system of claim 4, wherein each of the plurality of targets comprise a tee adapted to be removably positioned on the upper end of the pole.

6. The disc golf game system of claim 5, wherein each of the plurality of targets comprise a linkage connected through the tee, wherein the indicator of each of the plurality of targets is connected to the linkage.

7. The disc golf game system of claim 1, wherein the indicator of each of the plurality of targets comprises a ball.

* * * * *